US010532261B2

(12) United States Patent
Wheeler et al.

(10) Patent No.: US 10,532,261 B2
(45) Date of Patent: Jan. 14, 2020

(54) BOWLING BALL LAUNCHER

(71) Applicant: Spinway Technologies, LLC, Sun City, AZ (US)

(72) Inventors: Steven Wheeler, Sun City, AZ (US); Zachary Pelli, Philadelphia, PA (US)

(73) Assignee: Spinway Technologies, LLC, Sun City, AZ (US)

( * ) Notice: Subject to any disclaimer, the term of this patent is extended or adjusted under 35 U.S.C. 154(b) by 0 days.

(21) Appl. No.: 16/015,682

(22) Filed: Jun. 22, 2018

(65) Prior Publication Data

US 2018/0369672 A1 Dec. 27, 2018

Related U.S. Application Data

(60) Provisional application No. 62/523,391, filed on Jun. 22, 2017.

(51) Int. Cl.

| | |
|---|---|
| ***A63D 5/00*** | (2006.01) |
| ***A63B 69/00*** | (2006.01) |
| ***A63B 69/40*** | (2006.01) |
| *A63B 71/00* | (2006.01) |

(52) U.S. Cl.

CPC ..... *A63B 69/0046* (2013.01); *A63B 69/407* (2013.01); *A63B 71/0009* (2013.01); *A63B 2071/0018* (2013.01); *A63B 2220/833* (2013.01); *A63B 2243/0054* (2013.01)

(58) Field of Classification Search

CPC ... A63D 5/00; F41B 7/00; F41B 15/00; A63B 69/0046; A63B 69/407; A63B 2071/0018

USPC ..... 473/55, 56, 107; 273/107, 108.51, 273/108.52, 108.57, 119 R, 120 R, 120 A, 273/129 R, 129 Q, 129 S, 129 T, 129 V

See application file for complete search history.

(56) References Cited

U.S. PATENT DOCUMENTS

| | | | | |
|---|---|---|---|---|
| 191,998 A * | 6/1877 | Palatini | F41B 7/00 | 124/26 |
| 333,635 A * | 1/1886 | Ingersoll | F41B 7/00 | 124/26 |
| 785,667 A * | 3/1905 | Ferland | A63D 3/00 | 194/288 |

(Continued)

OTHER PUBLICATIONS

The Fallou 4 Far Harbor—The Striker , https://www.youtube.com/watch?v=B2oDHrzMW_o , May 2016.*

(Continued)

*Primary Examiner* — William M Pierce

(74) *Attorney, Agent, or Firm* — Brian M. Kaufman; Robert D. Atkins; Patent Law Group: Atkins and Associates, P.C.

(57) ABSTRACT

A bowling ball launcher has a frame and a rail oriented from a front of the frame to a back of the frame. A push pad is configured to slide along the rail. An elastic mechanism is coupled to the push pad and extends toward the front of the frame. A winch is coupled to the push pad toward the back of the frame. The winch includes a motor, a winch wheel, and a cable extending from the winch wheel to the push pad. The winch also includes a clutch between the motor and winch wheel. A shock absorber is disposed near the front of the frame. A plurality of position sensors is attached to the frame along the rail. A power meter is configured to move the push pad to one of the position sensors by operation of the winch.

18 Claims, 15 Drawing Sheets

(56) References Cited

U.S. PATENT DOCUMENTS 801,031 A * 10/1905 Merckling ..... A63D 3/00 473/107
1,073,431 A * 9/1913 Markray ..... 473/110
1,276,475 A * 8/1918 Barnes ..... A63F 7/025 273/121 R
1,625,980 A * 4/1927 Brinkman ..... A63D 5/08 473/107
2,109,638 A * 3/1938 Hawley ..... A63F 7/0005 473/107
2,109,639 A * 3/1938 Hawley ..... A63F 7/0005 124/16
RE21,538 E * 8/1940 Wilsey ..... A63D 13/00 124/16
2,277,964 A * 3/1942 Eckenboy ..... A63B 65/12 124/26
2,278,193 A * 3/1942 Discher ..... A63D 1/08 193/38
2,652,822 A * 9/1953 Griffith ..... F41B 7/006 124/27
3,142,292 A * 7/1964 Suchland ..... A63D 3/02 124/41.1
3,236,223 A * 2/1966 Rockwood ..... A63B 71/0009 124/37
3,329,433 A * 7/1967 Ryan ..... A63F 7/00 273/108.32
3,331,603 A * 7/1967 Webb ..... A63D 5/02 124/37
3,830,500 A * 8/1974 Ventura ..... A63B 65/12 124/10
3,888,483 A * 6/1975 Adickes ..... A63D 3/00 124/7
3,897,061 A * 7/1975 Grattan ..... F41B 7/00 124/26
4,086,901 A * 5/1978 Clement ..... F41B 3/02 124/21
4,335,701 A * 6/1982 Bozich ..... A63B 69/407 124/26
4,579,100 A * 4/1986 Whitaker ..... A63B 69/407 124/26
4,978,124 A * 12/1990 Brown ..... A63F 7/2472 273/129 S
5,447,144 A * 9/1995 Ivy ..... A63B 69/407 124/21
5,465,978 A * 11/1995 Magnone ..... A63B 69/0024 124/7
5,671,722 A * 9/1997 Moody ..... F41B 7/00 124/17
5,681,230 A * 10/1997 Krings ..... A63B 63/083 124/26
6,019,095 A * 2/2000 Sommer ..... A63D 3/02 124/4
6,379,257 B1 * 4/2002 Skleba ..... A63B 47/008 273/129 V
7,210,654 B1 * 5/2007 Cox ..... B64C 39/024 244/190
8,684,857 B2 * 4/2014 Buckley ..... A63D 3/02 273/129 V
9,022,016 B1 * 5/2015 Hafer ..... F41B 4/00 124/6
2012/0252592 A1 * 10/2012 Buckley ..... A63D 3/02 473/55
2016/0016095 A1 * 1/2016 Aguila ..... A63H 37/00 124/16

OTHER PUBLICATIONS

⅓ Bowling Ball Launcher—Real Life Striker from Fallout, https://9tube.tv/video/61394f61744f737075346f.html , Jun. 15, 2017.*
⅔ Bowling Ball Launcher Striker from Fallout, Jairus of All, https://www.youtube.com/watch?v=ysk08Hwn0Po , Jun. 22, 2017.*
Jerry Needs No Help Playing with his Ball, https://www.findclip.net/video/4PcL6-mjRNk/jerry-ne.html, Jan. 26, 2008.*
Adaptive Basketball Shoot Final Project Report, https://digitalcommons.calpoly.edu/cgi/viewcontent.cgi?referer=https://www.google.com/&httpsredir=1&article=1227&context=mesp. Jun. 2010.*
How do those wich-loaded shooters work?, https://www.chiefdelphi.com/t/how-do-those-winch-loaded-shooters-work/100825, Jan. 2010.*
Miller et al., Lightweight UAV Launcher, Senior Project for Aerojet-Rocketdyne, Final Report, Jun. 6, 2014 https://digitalcommons.calpoly.edu/cgi/viewcontent.cgi?article=1230&context=mesp.

* cited by examiner

BOWLING BALL LAUNCHER

CLAIM TO DOMESTIC PRIORITY

The present application claims the benefit of U.S. Provisional Application No. 62/523,391, filed Jun. 22, 2017, which application is incorporated herein by reference.

FIELD OF THE INVENTION

The present invention relates in general to the game of bowling, and, more specifically, to a bowling ball launcher.

BACKGROUND OF THE INVENTION

Bowling is a fun and challenging activity. A bowler inserts his or her fingers into the holes of a bowling ball and swings the ball underhanded to launch the ball down a bowling lane. The goal of the game is to score points by knocking down pins standing at the opposite end of the lane. The bowling lane is flanked on both sides by gutters. A rolled ball that strays too far to either side of the lane will fall in the gutter and be guided around the pins without a score for the bowler.

A big part of the fun of bowling is rolling the bowling ball down the lane at high speeds. A fast rolling ball increases the pace of the game, provides a more satisfying impact with the bowling pins, and increases scores by causing the pins to bounce around the pin deck with more energy, which generally results in more pins being knocked down and a higher score.

Many people, particularly children or those with handicaps, desire to participate in bowling but are not physically capable of rolling a bowling ball down the lane. Several technologies are available that allow children to participate in bowling. Some bowling alleys offer bumpers that can be deployed to prevent the bowling ball from falling into the gutters. Rather than falling in the gutter and being routed around the pins, the ball bounces off the bumper back toward the center of the lane. Bumpers help children, who commonly have trouble rolling the ball straight down the lane, be able to hit the pins instead of only getting gutter balls. However, the bumpers do not increase the speed of a child's roll, and do not significantly help a handicapped person who is physically unable to roll a bowling ball in the first place.

Bowling alleys may offer bowling ramps, which use the force of gravity to launch a bowling ball down a bowling lane. A user places a bowling ball on top of the ramp, and the ball gains speed as it rolls down the ramp. The ramp allows a user to get a ball down the lane who otherwise would not be able to do so, e.g., a handicapped person in a wheel chair or a child who simply cannot roll the ball with sufficient speed to reach the pins. However, the ramp is a passive device that still does not launch the ball with a satisfying amount of speed. The ball rolls off the ramp and down the lane at a leisurely pace, having enough speed to knock down the pins but not enough to really send the pins flying as desired.

Therefore, a need exists for a device that can propel a bowling ball down a bowling lane at speeds comparable to a capable bowler.

BRIEF DESCRIPTION OF THE DRAWINGS

FIGS. 2*a*-2*l* illustrate operation of the bowling ball cannon.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1A:
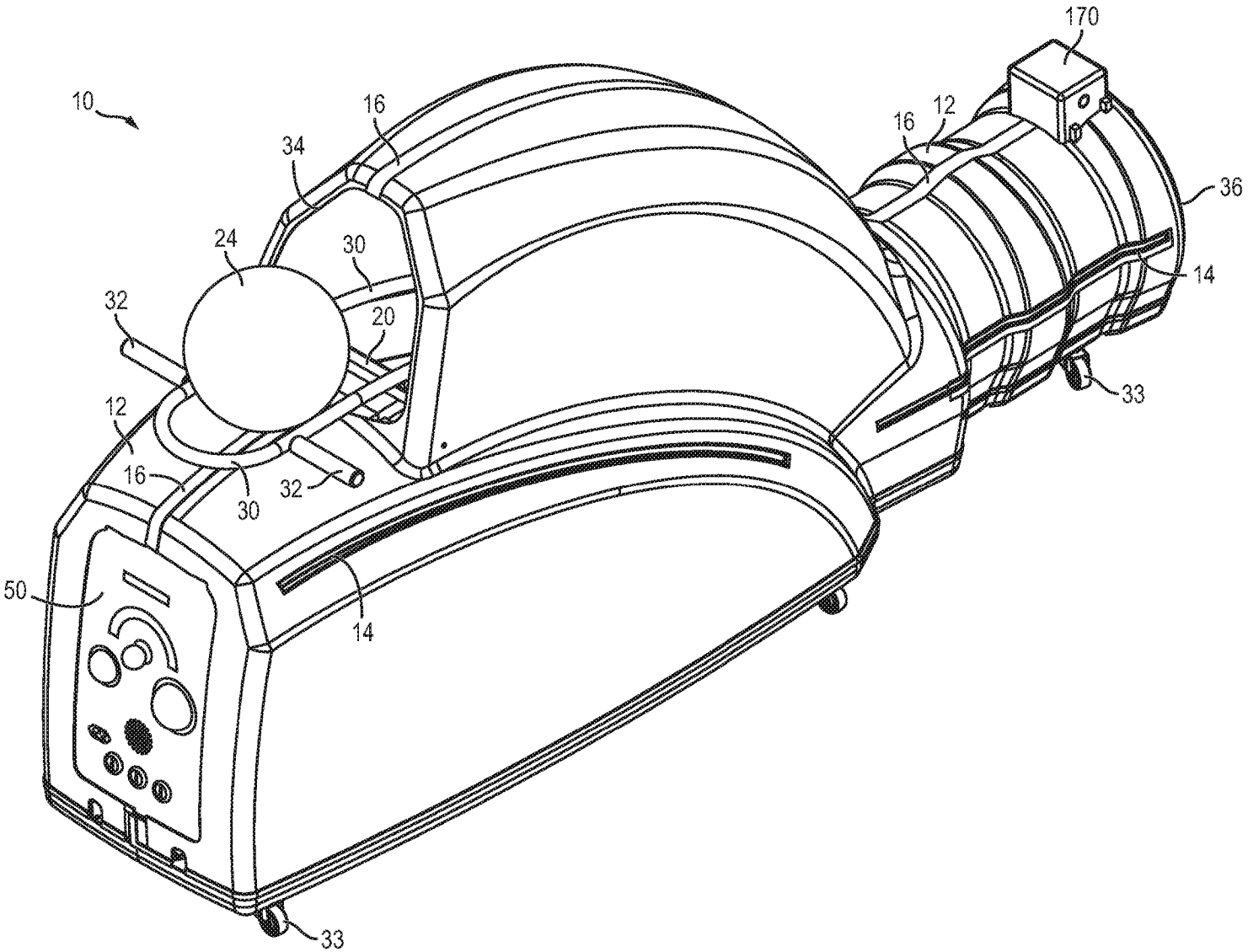
FIGS. 1*a*-1*c* illustrate a bowling ball cannon.
Figure 1B:
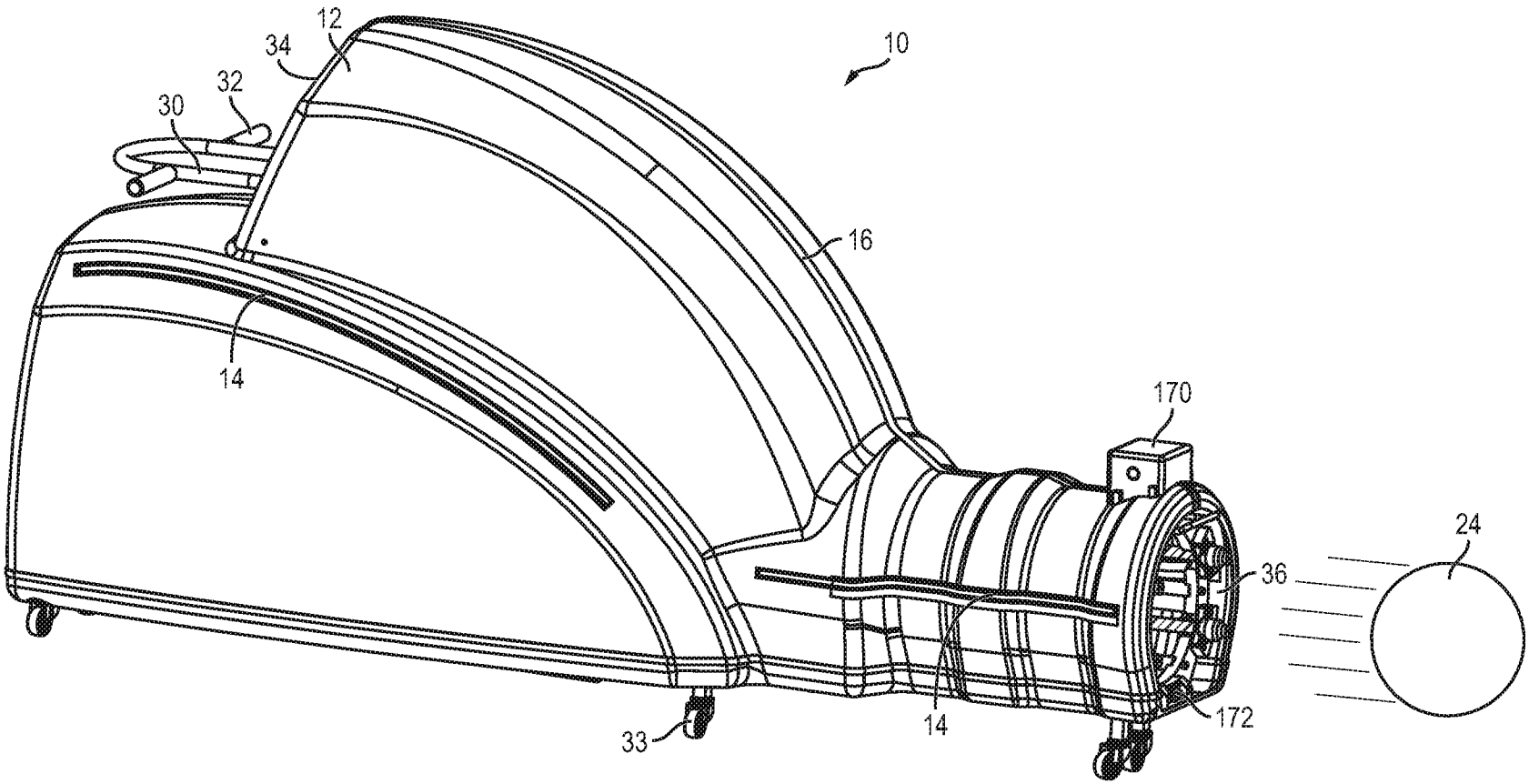
Figure 1C:
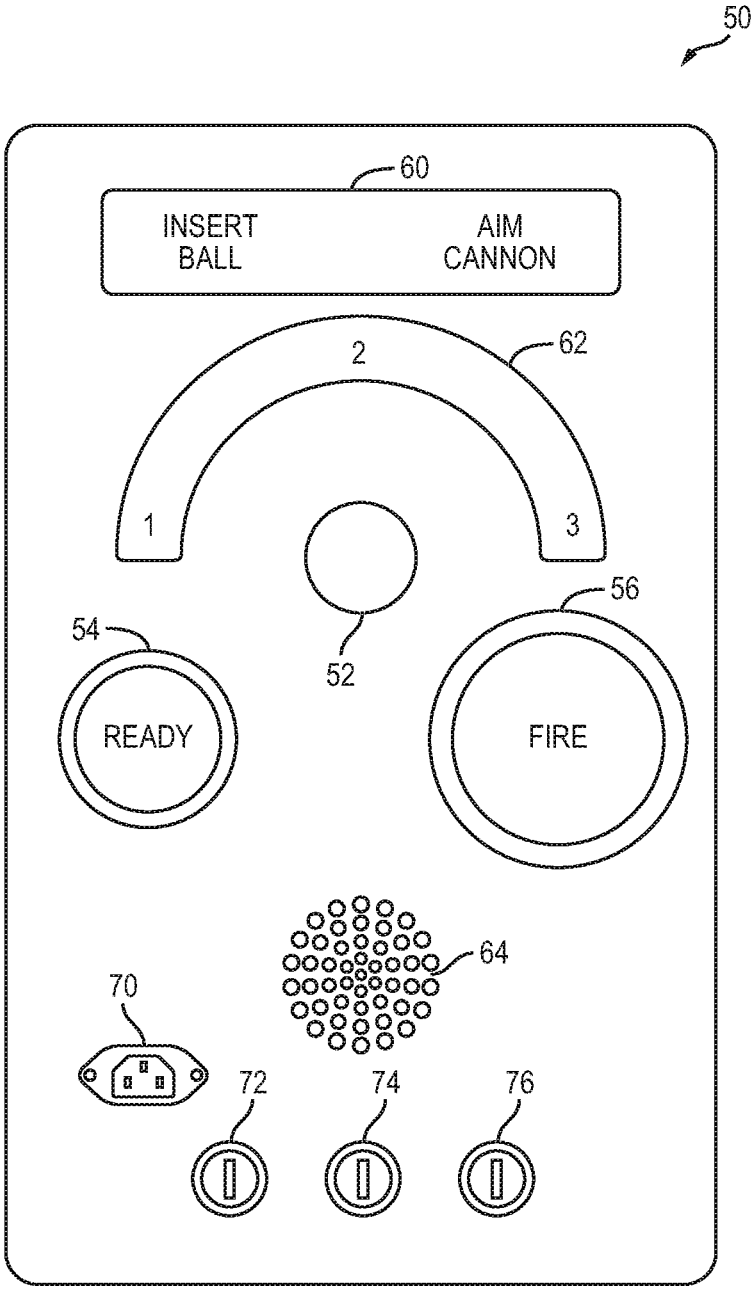

FIGS. 1*a*-1*c* illustrate a bowling ball launcher or cannon 10. The mechanical components of cannon 10 responsible for launching a bowling ball are contained within a shell 12. Shell 12 is formed from multiple molded plastic pieces in one embodiment. The shape of shell 12 can be modified as necessary to envelop and allow operation of the mechanical components, and provide openings for insertion and expulsion of a bowling ball. Shell 12 can also be shaped to apply a theme to cannon 10, e.g., the shell can be given extensions along the top shaped like dermal plates for a dinosaur themed cannon or wings can extend from the side of the shell for an airplane theme. In other embodiments, cannon 10 is themed by simply adding a printed vinyl sticker shaped to conform to shell 12, by painting the shell, or by any other suitable method of adding a graphic design.

Shell 12 optionally includes cutouts or grooves 14 for installation of light-emitting diodes (LEDs) or other design elements. LED strips disposed in grooves 14 are electrically coupled to control circuitry within shell 12. The lights can be manipulated during use of cannon 10 to enhance the user experience. In one embodiment, shell 12 is formed from multiple pieces mechanically attached to each other. Shell 12 as illustrated is formed from a bottom piece, a left piece, and a right piece. A seam 16 between the left and right portions of shell 12 can be covered by weather stripping. The weather stripping can include visual patterning matching the theme of shell 12, and may include embedded LEDs similar to grooves 14.

The bottom portion of shell 12 is attached to an internal frame 20, and the internal mechanisms of cannon 10 are mounted onto the frame. The left and right portions of shell 12 are assembled around frame 20 and the internal components, and over the bottom portion of the shell. The portions of the shell can be clipped together by clips integrated into the respective molded shapes, or held together by separate clips, bolts, screws, or other suitable fasteners. In one embodiment, the left and right portions of shell 12 are attached to frame 20 rather than to each other.

A user ready to use cannon 10 to propel bowling ball 24 down a bowling lane places the ball on railings 30 as seen in FIG. 1*a*. Railings 30 include handles 32 extending to the left and the right. Handles 32 are grabbed by a user to aim cannon 10, changing the angle that cannon 10 launches ball 24 down a bowling lane. Cannon 10 includes caster wheels 33 for easy repositioning on the smooth floor of a bowling alley using handles 32. A user can use handles 32 to aim cannon 10 before or after placing ball 24 on railings 30. Railings 30 guide ball 24 through opening 34 of shell 12 and down into the internal mechanisms for proper firing. When aimed as desired, and with ball 24 loaded, a user fires the ball from barrel opening 36, as shown in FIG. 1*b*, using control panel 50.

Control panel 50 is illustrated in more detail in FIG. 1*c*. A user controls cannon 10 through joystick 52, ready button 54, and fire button 56. Feedback is provided to the user through status display 60, power meter 62, speaker 64, as well as lights embedded within joystick 52, button 54, and button 56. An owner of cannon 10 accesses various administrative functions through keyholes 72, 74, and 76.

Status display 60 is initially lit to instruct a user to insert a bowling ball and aim the cannon. Status display 60 is a fixed display with backlighting that is either turned on or off depending on the state of cannon 10. Wording is printed on a substrate in front of the backlights, which make the words visible, or at least more noticeable, when turned on. In other embodiments, status display 60 can be simple LEDs or a display screen. In some embodiments, only the LED for "INSERT BALL" is turned off when a ball is inserted. In other embodiments, the light for "INSERT BALL" is controlled together with "AIM CANNON" and both lights stay on and turn off together. Users can be instructed to aim the cannon prior to inserting a ball, and the entire display 60 is turned off when a ball is inserted.

Power meter 62 indicates the power level that cannon 10 is currently set to, and represents how much energy is used to launch ball 24. Cannon 10 includes three different power levels, indicated by the numbers one, two, and three on power meter 62. Power level one is the lowest power level, and launches ball 24 at the lowest speed. Power level three is the highest power level, and launches ball 24 at maximum speed. Other designations for power levels are used in other embodiments.

Cannon 10 can default to power level one for each inserted ball 24, remember the most recent power level used, or remember the most recent power level used for the current bowler. Any number of discrete power levels are used in other embodiments. The power mechanism could also allow analog adjustment. In one embodiment, joystick 52 lights up during the time when power adjustment is available to the user as an indicator of such. Power adjustment normally takes place after cannon 10 is aimed and ball 24 is inserted, however, power adjustment can be allowed at any time prior to firing the cannon if desired.

Power meter 62 is a translucent plastic or glass sheet mounted in control panel 50 that includes LEDs embedded behind the numbers one, two, and three. The numbers one, two, and three are printed on a translucent substrate as with status display 60. The LEDs light up the number within meter 62 according to which power level cannon 10 is currently set to. An analog gauge, a display panel, or other suitable means are used to communicate power level to a user in other embodiments. In some embodiments, status display 60 and power meter 62 are implemented as a single display screen. The screen can include touch capability for controlling functions of cannon 10.

Joystick 52 is used to control the power setting of cannon 10. A user can tap joystick 52 upward to raise the power level of cannon 10, and tap the joystick downward to lower the power level. In other embodiments, other mechanisms are used to adjust the power level, e.g., a single button to toggle through the various available power levels, separate buttons to raise and lower the power level, or a separate button for each available power level.

Once cannon 10 is aimed, ball 24 is inserted, and a power level is selected, a user presses ready button 54 to lock in all settings and ready the cannon for firing. In one embodiment, cannon 10 unlatches a safety mechanism that prevents the cannon from inadvertently firing, or performs safety checks when ready button 54 is pressed. Ready button 54 can light up when the function is available, and may blink to remind a user to press the ready button. The internal logic of cannon 10 can prevent all controls of cannon 10 other than fire button 56 once ready button 54 is pressed. Fire button 56 can be lit up by an underlying LED to indicate that cannon 10 is ready to fire. Pressing fire button 56 after ready button 54 causes ball 24 to be shot out of barrel opening 36.

Speaker 64 gives audible instructions, feedback, and encouragement to the user. Speaker 64 can make various sound effects when certain things happen or give spoken feedback and directions. The sound effects can include a cannon firing sound when the cannon 10 is fired, warping sounds when the power level is changed, etc. Speaker 64 can speak a welcome message when cannon 10 is first powered on, can prompt a user on what steps to perform, and can give congratulations after ball 24 is fired.

Power plug 70 is used to plug cannon 10 into a wall outlet using a power cord. Cannon 10 is normally powered by internal rechargeable batteries during use, and a manager at the bowling alley plugs in the cannon after use to recharge the batteries. Cannon 10 can also be powered during use by electrical mains power through plug 70.

Keyholes 72-76 are operated by an employee of the bowling alley who has possession of a key that fits into the keyholes. Keyholes 72-76 can be multi-positional switches that control electrical contacts within the keyholes to modify various settings. Keyhole 72 is an on-off switch that has one position to turn cannon 10 off and a second position to turn the cannon on. In some embodiments, keyhole 72 includes a third position to place cannon 10 into a demo mode where the cannon goes through various light and sound routines to attract attention or demonstrate capabilities. Demo mode may also allow a user to operate control panel 50 through the process of firing without actually operating the mechanical parts of cannon 10.

Keyhole 74 is an audio switch that allows speaker 64 to be disabled in one position, or enabled in a second position. In other embodiments, keyhole 74 includes additional positions to control sound volume at a plurality of discrete levels. Keyhole 76 is a mechanical latch that locks control panel 50 onto shell 12. When keyhole 76 is unlocked, control panel 50 can swing open to access the internal mechanisms for adjustment or repair.

Figure 2A:
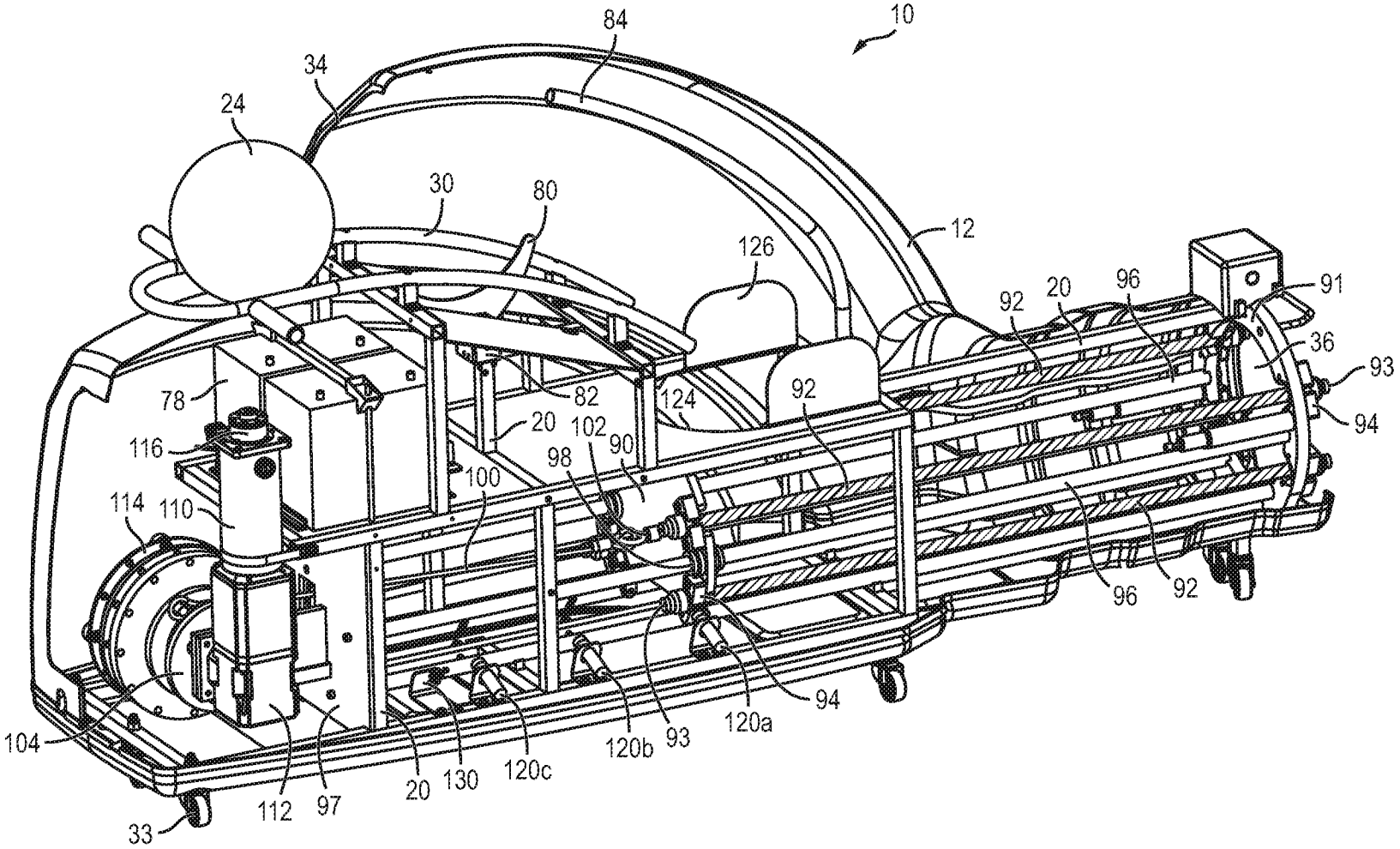

FIGS. 2*a*-2*l* illustrate the internal mechanisms that work to launch bowling ball 24 from cannon 10. FIG. 2*a* illustrates cannon 10 from FIG. 1*a* with the right side of shell 12 removed to reveal the internal mechanisms. Bowling ball 24 has been placed by a user on rails 30. Rechargeable batteries 78 are illustrated sitting on frame 20 near the back of cannon 10. Batteries 78 are optionally bolted to frame 20 using a bracket.

A ball prevention plate 80 is disposed between rails 30 just inside opening 34. Ball prevention plate 80 is controlled by a solenoid box 82. Solenoid box 82 contains a solenoid pin that is spring loaded to press against plate 80 when the ball prevention plate is in the position of FIGS. 2*a* and 2*b*. The solenoid pin of solenoid box 82 springs out when ball 24 rolls by, as in FIG. 2*c*, to block ball prevention plate 80 from returning to the position of FIG. 2*a*. When ready to accept a new ball, solenoid box 82 receives power and pulls back the solenoid pin. Prevention plate 80 is spring loaded to return to the position shown in FIG. 2*a* when solenoid box 82 is released. A spring, not illustrated, is installed between opening 81*a* in ball prevention plate 80 and opening 81*b* in frame 20 to pull back the ball prevention plate. Ball prevention plate 80 stops the roll of ball 24 along rails 30 to keep the ball from entering the launching mechanism until ready.

Solenoid box 82 includes a ball load switch that detects when a ball rolls into prevention plate 80. The ball load switch can also be separate from solenoid box 82. In one embodiment, a proximity sensor is installed over rail 30 or on extension bar 84 to sense when a ball is present. In other embodiments, no ball load switch is used, and ball prevention plate still works reliably to let through only one ball at a time.

Once the launching mechanism of cannon 10 is ready, solenoid box 82 releases ball prevention plate 80, which springs back to accept ball 24. Solenoid box 82 is turned back off so that the solenoid pin presses against ball prevention plate 80. The weight of ball 24 rolling down rails 30 rotates ball prevention plate 80 forward to the position shown in FIG. 2*c*. The spring loaded pin of solenoid box 82 expands out once ball prevention plate 80 rotates past, latching the ball prevention plate in the position of FIG. 2*c*.

In other embodiments, ball prevention plate 80 is actuated by a linear actuator or another suitable mechanism. A bar or plate can be actuated within opening 34 to block bowling balls from being inserted when the launch mechanism is not ready to accept a ball, in addition to or instead of ball prevention plate 80.

Frame 20 includes an extension bar 84 over ball prevention plate 80 so that any upward force of ball 24 is absorbed by the metal frame rather than the plastic shell 12. Extension bar 84 is positioned so that ball 24 does not fit between ball prevention plate 80 and the extension bar without being released by solenoid box 82.

The launching mechanism of cannon 10 includes a push pad 90 that is used to launch ball 24 out of barrel opening 36. To launch ball 24, push pad 90 is propelled by elastic bands 92 that extend from the push pad to barrel frame 91. Barrel frame 91 is part of frame 20 surrounding barrel opening 36. Elastic bands 92 apply a force to push pad 90 toward barrel frame 91, which is responsible for launching ball 24. Elastic bands 92 are formed from latex rubber, another polymer, or any other suitable elastic material, and are shaded in the figures for easier visual distinction. In other embodiments, metal springs or another type of elastic mechanism are used instead of elastic bands.

Elastic bands 92 include flanges 93 at each end that are held at push pad 90 and barrel frame 91 by brackets 94. Flanges 93 can be a thicker portion of the elastic material that is not pulled through brackets 94 at the forces generally applied in cannon 10. Flanges 93 can also be formed by embedding a mechanically stronger material, e.g., steel or plastic, within elastic bands 92, clamping a stronger material around the bands, tying the bands in a knot, or by another means suitable to resist deformation through brackets 94.

The launch mechanism of cannon 10 includes slide rails 96 extending through push pad 90 from barrel frame 91 to rear frame plate 97. Slide rails 96 are a cylindrical shaped rail extending parallel to the movement of ball 24 being launched from cannon 10. In other embodiments, rails 96 include a square, triangular, or other shape of cross-section.

Push pad 90 includes bushings 98 or another type of linear bearing to mechanically support the push pad on rails 96 and reduce wear and tear. Grease or another lubricant can be applied between rails 96 and bushings 98 to reduce friction. Rails 96 remain in fixed position within cannon 10, extending from barrel frame 91 to rear plate 97. Push pad 90 moves freely on rails 96, with the position of the push pad controlled by forces from elastic bands 92 and cable 100.

Elastic bands 92 provide a force on push pad 90 toward barrel opening 36 by virtue of the elasticity of the bands. Cable 100 provides a force on push pad 90 away from barrel opening 36 to pull back the push pad and add energy to elastic bands 92. The general operating principle of the launch mechanism of cannon 10 is similar to a slingshot. Cable 100 pulls back on push pad 90, which adds energy to the system by stretching out elastic bands 92. To launch ball 24, the force of cable 100 is removed, which allows elastic bands 92 to contract. The energy stored in elastic bands 92 is transferred to ball 24 through push pad 90, launching the ball down the bowling lane.

Elastic bands 92 represent only one potential option for the storage of energy and release of the energy to ball 24. Cable 100 connected to a winch represents only one potential option for adding energy to the system. The energy storage and release mechanism could be in front of push pad 90, as with bands 92, or behind the push pad. For instance, a spring could be compressed between push pad 90 and rear plate 97 to add energy. The mechanism for pulling back push pad 90 to add energy could be a lead screw or another suitable mechanism. The mechanism for pulling back push pad 90 to add energy could be in front of the push pad, or extend along the length of the cannon adjacent to the push pad, rather than only behind the push pad as with cable 100.

In some embodiments, the energy storage and release mechanism does not involve pulling back push pad 90 to add energy. The energy storage could be by compressing air into a tank without movement of push pad 90. In that case, the mechanism for adding energy would be an air pump adding air to the tank rather than a winch pulling a cable. Any suitable energy storage and release mechanisms are usable in other embodiments. In some embodiments, no energy storage mechanism is used, and push pad 90 is directly propelled by a motor converting electrical energy from batteries 78 or outlet 70 to mechanical energy in push pad 90 without intermediate storage. Push pad 90 is coupled to a hydraulic actuator in other embodiments.

Push pad 90 includes an eye bolt 102 attached on a back side of the push pad for attachment of cable 100. Cable 100 is looped through eye bolt 102 and clamped into a loop for a semi-permanent attachment. In other embodiments, other attachment mechanisms for cable 100 to push pad 90 are used. Cable 100 is attached to winch wheel 104 at the opposite end of the cable from push pad 90. A motor 110 turns winch wheel 104 through gear box 112 and clutch 114. As motor 110 turns, cable 100 is wrapped around winch wheel 104 to pull back push pad 90. Clutch 114 is capable of disconnecting winch wheel 104 from motor 110, allowing elastic bands 92 to propel push pad 90 forward and launch ball 24. A brake 116 on motor 110 allows the motor to keep winch wheel 104 from turning without expending substantial battery power. Brake 116 is turned on when push pad 90 reaches one of the power positions to hold the push pad in place. Brake 116 is released when moving push pad 90 to another power position. In some embodiments, brake 116 is released when cannon 10 is fired.

Cannon 10 uses three proximity sensors 120 to detect the position of push pad 90 along rails 96. Proximity sensors 120 can be photo detectors, capacitive proximity sensors, or any other sensing technology that allows detection of push pad 90. The three sensors 120*a*, 120*b*, and 120*c* correspond to the three possible power levels, one, two, and three, respectively, displayed in power meter 62. Cannon 10 automatically pulls back push pad 90 to sensor 120*a* on power up of the cannon or after a ball is fired. The position of sensor 120*a* is just behind ball drop opening 124, where ball 24 drops down into the launch mechanism. Frame 20 includes a pair of flaps 126 flanking opening 124 to contain ball 24. When a user turns the power up from level one to level two, motor 110 turns winch wheel 104 to pull back push pad 90 until the push pad is detected adjacent to sensor 120*b*. Likewise, when level three selected, push pad 90 is pulled back to sensor 120*c*.

Normally, push pad 90 will never be pulled back behind sensor 120*c*, which corresponds to the highest power level. However, if a malfunction occurs that prevents push pad 90 from being detected by sensor 120*c*, motor 110 could continue pulling back beyond the desired maximum. Push pad 90 will trip a mechanical safety switch 130 behind sensor 120*c* if the last sensor is missed. Switch 130 has a very low rate of failure and malfunction, and serves as a backup for the proximity detection sensors 120. If switch 130 is pressed, cannon 10 can either let push pad 90 move forward to see if the problem was transient, or shut down completely and create an alert that maintenance is necessary.

Figure 2B:
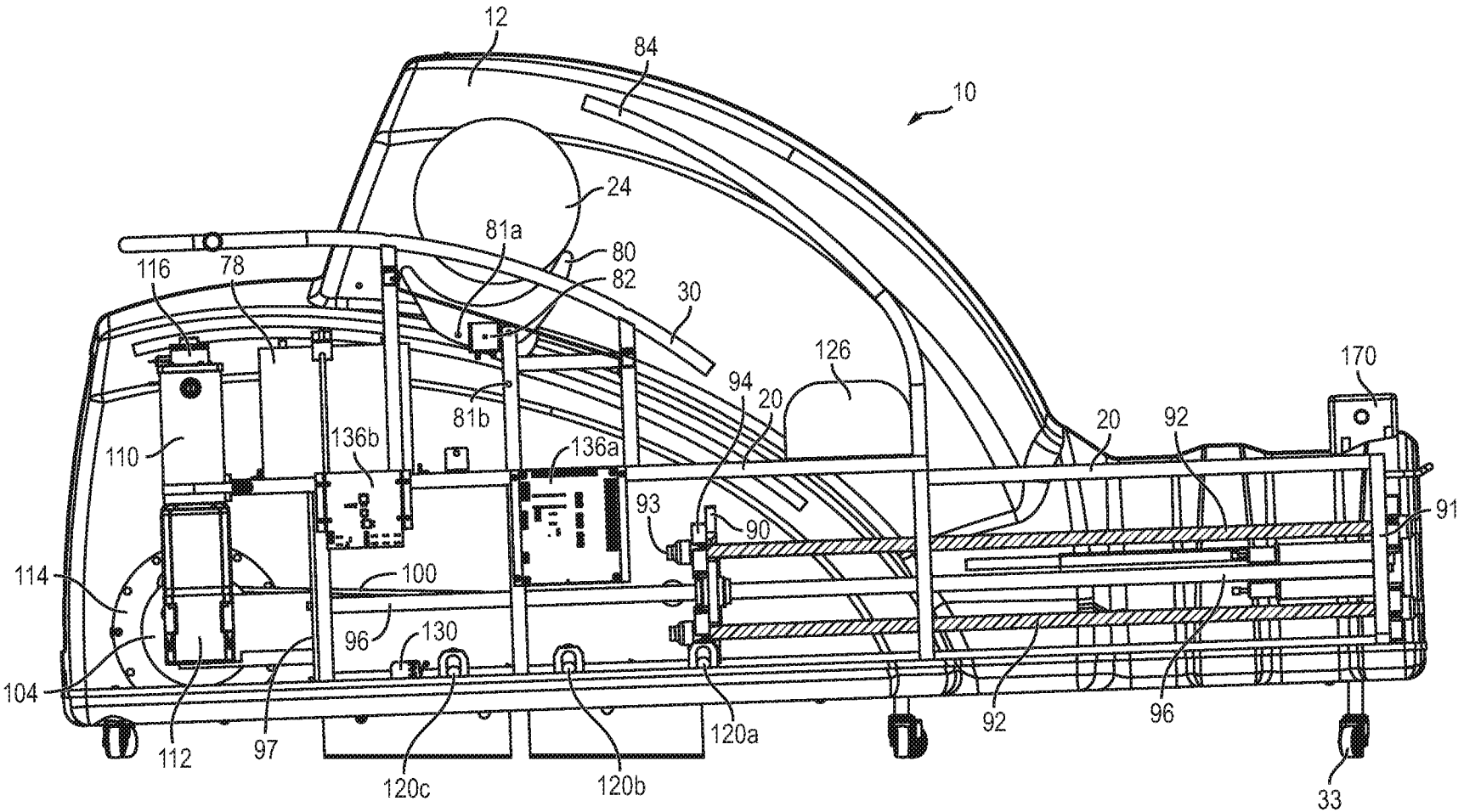

Continuing from FIG. 2*a*, FIG. 2*b* illustrates ball 24 having rolled down rails 30 to ball prevention plate 80. Solenoid box 82 includes a pin that retracts to allow ball prevention plate to spring to the position shown in FIG. 2*a* when the launch mechanism is ready to accept ball 24. The conditions that indicate the launch mechanism is ready for ball 24 to drop is that push pad 90 is back at least to sensor 120*a* so that the ball will drop in front of the push pad, and there is not already a ball within the launch mechanism. When ball 24 is dropped into cannon 10, the ball rolls past ball prevention plate 80 and trips the ball load switch, signaling that a ball has been loaded. Once a ball is loaded in the launching mechanism, the ball release solenoid in solenoid box 82 stays off, keeping ball prevention plate 80 in the position of FIG. 2*c* and preventing a second ball being inserted until cannon 10 has been fired and push pad 90 resets to the first power position.

The ball load switch is wired to the electronics of cannon 10 to provide input as to when a ball is inserted into the cannon. Cannon 10 includes a pair of printed circuit boards (PCBs) 136 that include the control and power circuitry of the cannon. PCBs 136 are mounted onto frame 20. In one embodiment, PCB 136*a* is a logic board that controls the functionality of cannon 10, and PCB 136*b* is a power board that distributes power from batteries 78 to motor 110, clutch 114, solenoid box 82, logic board 136*a*, and other elements of cannon 10 that require electrical power. Power board 136*b* is also responsible for charging batteries 78 from outlet 70.

All sensor and switch inputs are routed to logic board 136*a* for processing. Logic board 136*a* generates control outputs based on the inputs. Power board 136*b* is controlled by logic board 136*a* to direct power as necessary to operate the launching mechanism and implement other functionality described above and below. The electrical functionality of cannon 10 can be all on one PCB in other embodiments, or split across any number of PCBs in any suitable configurations. Alternatively, cannon 10 can be entirely electrically configured and controlled by a programmable logic controller (PLC), field-programmable gate array (FPGA), an industrial control system, a personal computer, a single-board computer, or another suitable electronic device.

Once a ball is detected, cannon 10 can stop prompting the user to insert a ball and prevents a second ball from being inserted by keeping solenoid box 82 engaged. When cannon 10 is ready for another ball, solenoid box 82 is powered up to pull back the solenoid pin and allow a ball into ball prevention plate 80. Ball 24 rolls over ball prevention plate 80, tripping the ball load switch, and continues rolling down through opening 124 to the launch mechanism below. Power has already been cut to solenoid box 82, so the spring loaded pin expands and latches ball prevention plate 80 into the position of FIG. 2*c*. In other embodiments, power is cut to solenoid box 82 in response to detection of ball 24 by the ball load switch.

The curved shape of ball prevention plate 80 reduces the likelihood of two balls rolling down into the launch mechanism. As ball 24 rolls past ball prevention plate 80, the ball prevention plate rotates so that the back end of the ball prevention plate extends between rails 30. If a second ball were on rails 30 behind ball 24, the back end of ball prevention plate 80 would keep the second ball from also rolling down into the launch mechanism immediately behind ball 24.

In one embodiment, ball prevention plate 80 is spring loaded to automatically return to the position seen in FIG. 2*b*. Solenoid box 82 then keeps ball prevention plate 80 in the position of FIG. 2*b* until the launch mechanism is ready for another ball. Solenoid box 82 is used to release ball 24, and a second ball loaded onto rails 30 will be stopped by ball prevention plate 80 in the position of ball 24 in FIG. 2*b*.

Figure 2C:
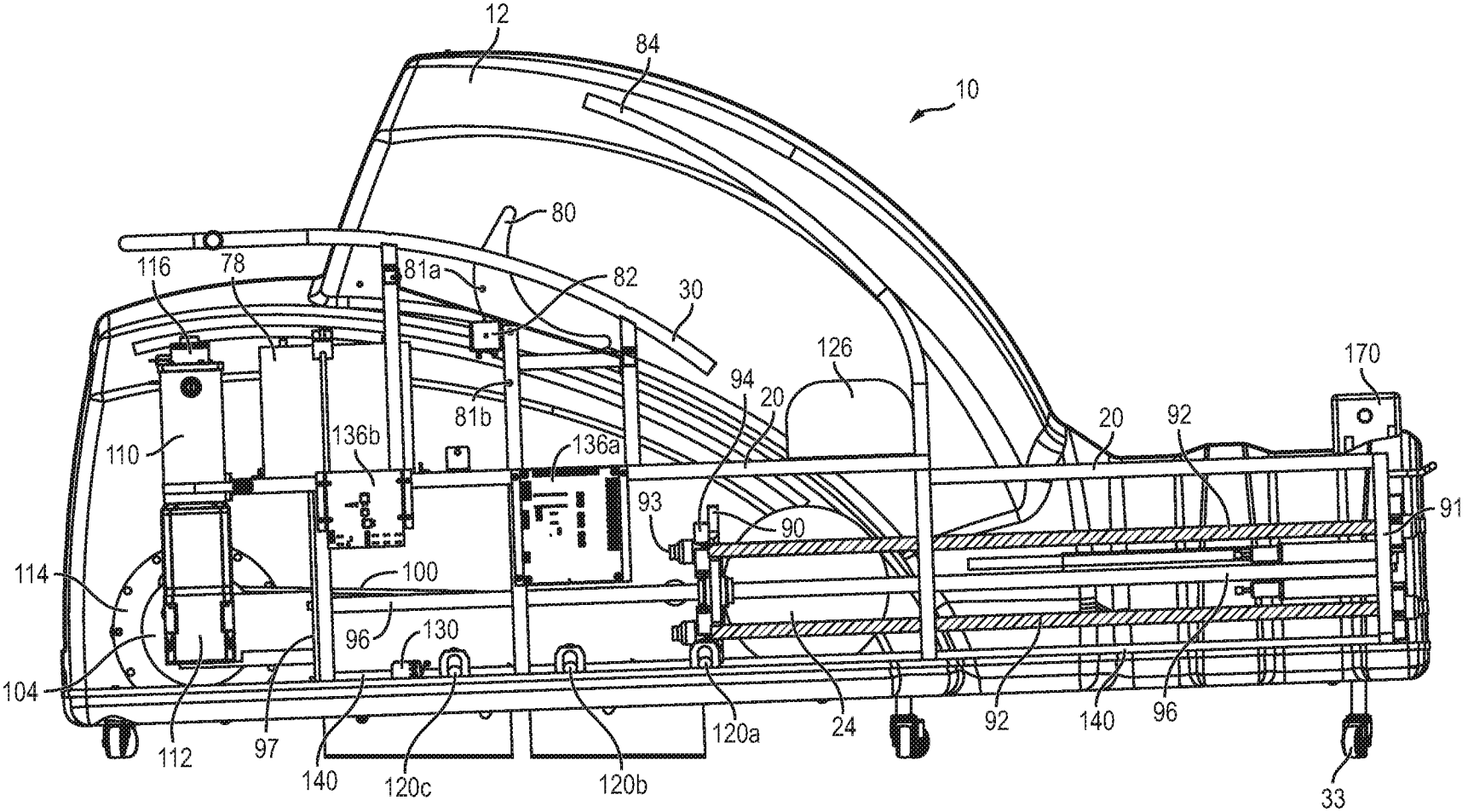
Figure 2D:
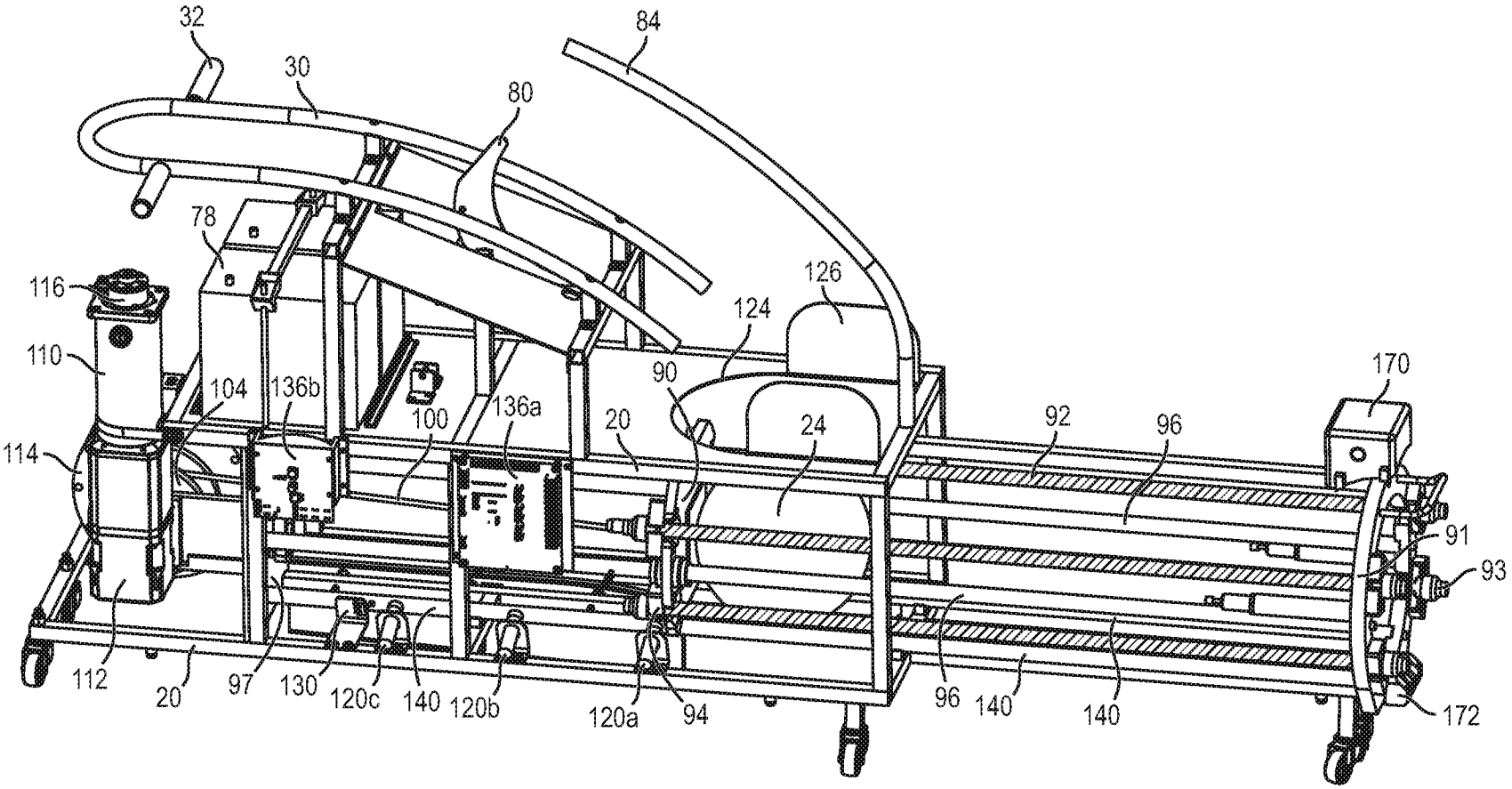

FIGS. 2*c* and 2*d* illustrate ball 24 after having rolled down through opening 124 and now resting on rails 140. Rails 140 are below, and closer together than, rails 96 so that ball 24 sets on rails 140 and between rails 96. Cannon 10 sets with a slight tilt backwards so that ball 24 rolls back on rails 140 to push pad 90 no matter which power setting the cannon is at. Ball 24 rolls forward and backward on rails 140 as push pad 90 moves forward or backward. In FIGS. 2*c* and 2*d*, cannon 10 is loaded and could be fired from the first power position.

On the other hand, a kid might want to increase the power level, and thus the speed at which ball 24 rolls down the bowling lane. Pressing joystick 52 upward causes motor 110 to pull back push pad 90 to the second or third power positions. In some embodiments, cannon 10 generates a power-up sound effect from speaker 64 when the power level is increased.

Figure 2E:
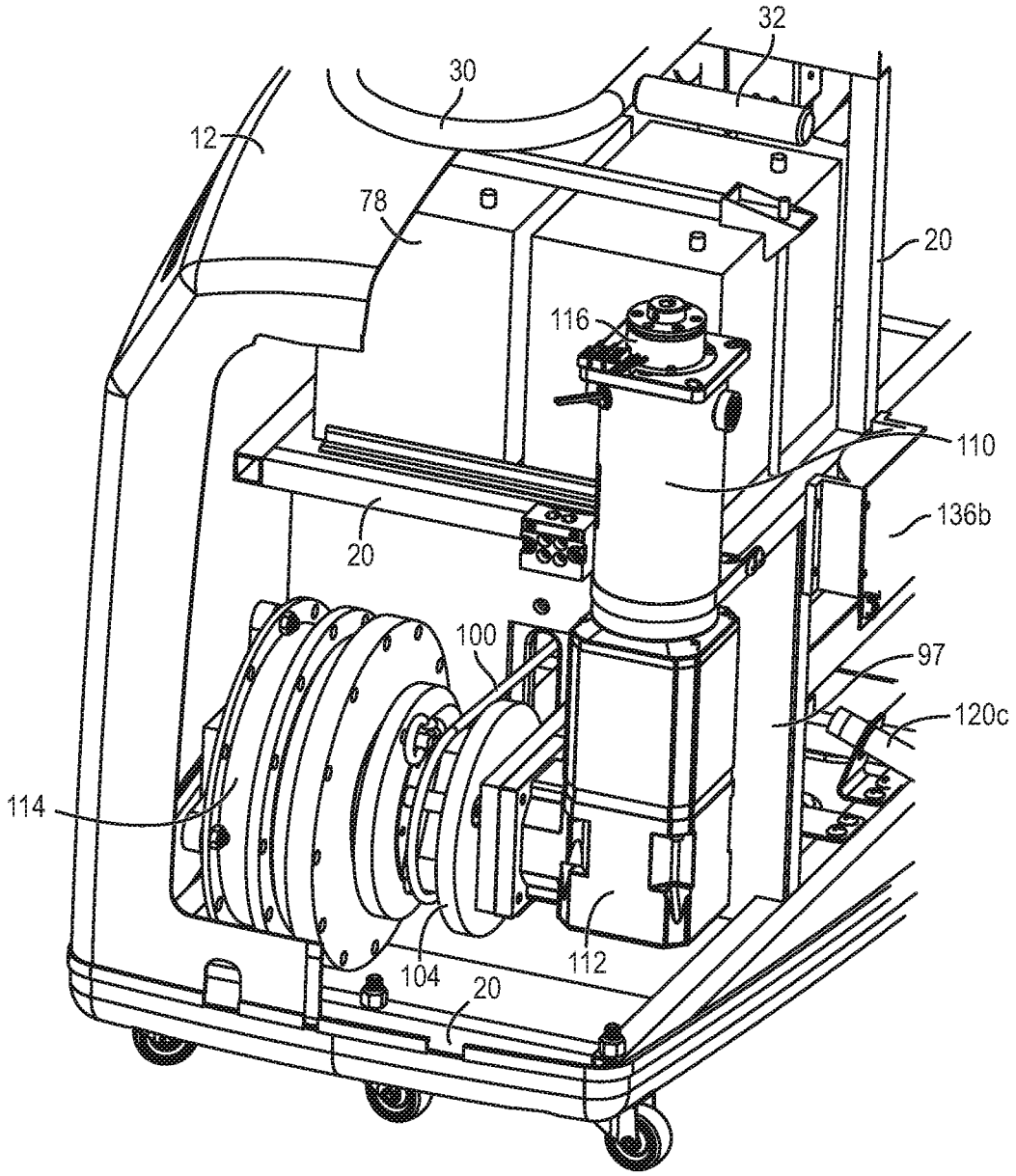

FIG. 2*e* illustrates detail of the winch assembly used to pull back on push pad 90. Clutch 114 normally provides a mechanical connection between gear box 112 and winch wheel 104. Electrical power applied from batteries 78 through power board 136*b* to motor 110 causes mechanical power to be applied from the motor through gear box 112 to clutch 114. Gear box 112 has a 100-to-1 gearing in one embodiment, so that mechanical force from motor 110 is multiplied by 100 to clutch 114. Clutch 114 transfers the mechanical power from motor 110 to winch wheel 104, winding cable 100 further and pulling back push pad 90 from power position one to power position two, and then power position three if selected. When power is applied to clutch 114 from batteries 78 by power board 136*b*, clutch 114 is disengaged and allows winch wheel 104 to free spin. The power stored in elastic bands 92 pulls push pad 90 forward and unwinds cable 100 from winch wheel 104.

Figure 2F:
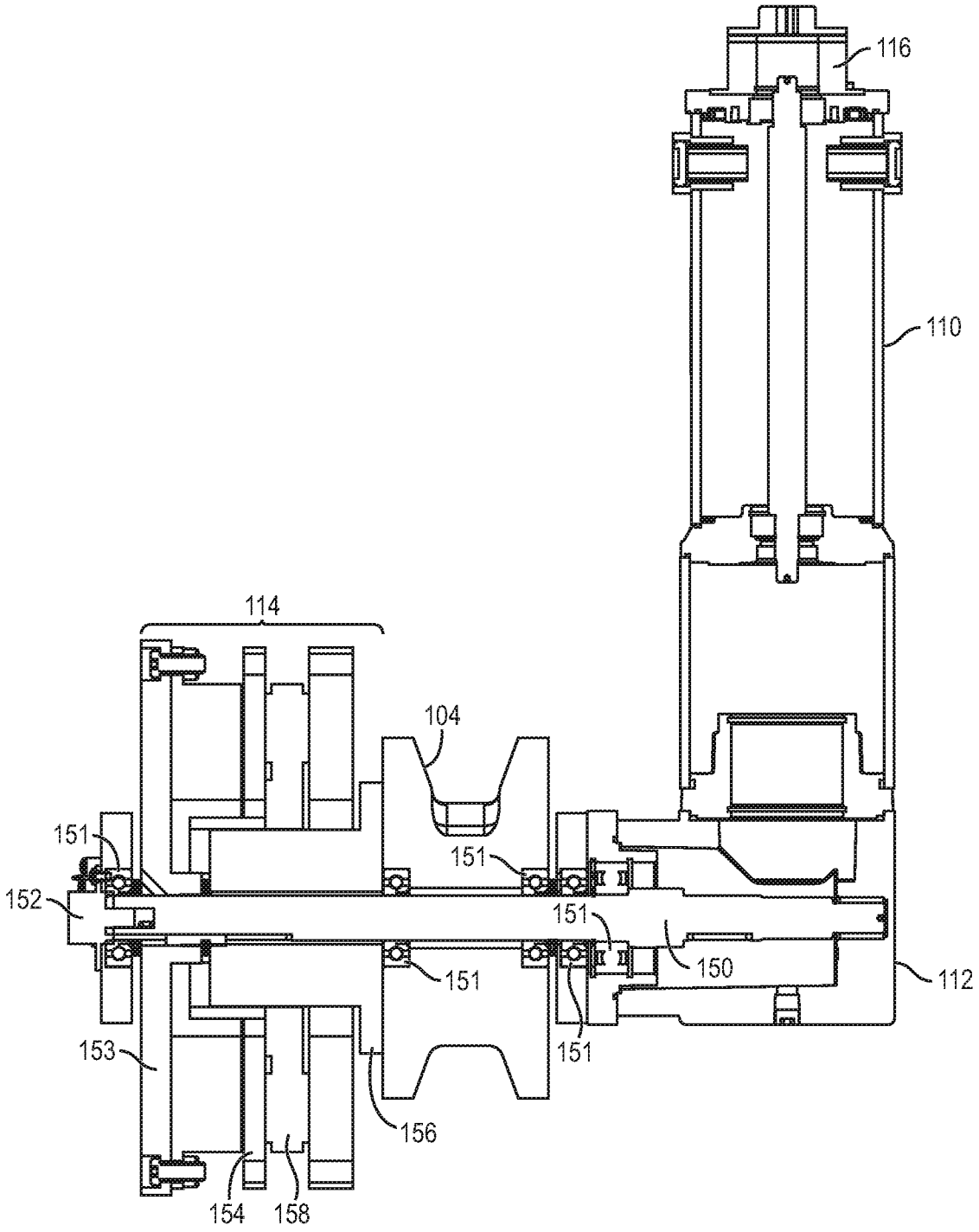

FIG. 2*f* shows a cross-section of the winch assembly. Gear box 112 uses mechanical power from motor 110 to turn power take-off (PTO) axle 150. Axle 150 extends through the center of winch wheel 104 without directly physically contacting the winch wheel. In some embodiments, ball bearings 151 are disposed between axle 150 and other parts, such as winch wheel 104, which may rotate relative to the PTO axle. Axle 150 extends from gear box 112 to slip ring 152. Slip ring 152 is fixed to frame 20 to hold the end of axle 150 for stability. A bearing 151 allows axle 150 to rotate freely within slip ring 152. Axle 150 is fixed to plate 153 of clutch 114. When axle 150 turns, plate 153 is turned. Plate 153 is attached to a brake rotor 154. A wire is wound in the space between plate 153 and brake rotor 154 to form an electromagnet.

Winch-brake connector 156 is bolted onto winch wheel 104 and turns with the winch wheel. A brake pad 158 is attached around winch-brake connector 156. In one embodiment, brake pad 158 has a hexagonal opening that is slightly larger than a hexagonal outer surface of winch-brake connector 156 to allow the brake pad to slide along the winch-brake connector while both still rotate together. Brake pad 158 slides left and right on winch-brake connector 156 depending on whether the electromagnet between rotor 154 and plate 153 is turned on or off. When the electromagnet is off, i.e., no power is being provided to clutch 114, brake pad 158 presses against rotor 154 so that winch wheel 104 is turned by motor 110. Friction between brake pad 158 and rotor 154 transfer mechanical power through clutch 114. When the electromagnet is turned on by power supplied to clutch 114, brake pad 158 is pushed away from rotor 154 by the magnetic force to mechanically disconnect winch wheel 104 from motor 110. Clutch 114 connects winch wheel 104 to motor 110 to pull back push pad 90 and hold the push pad in position. Clutch 114 disconnects winch wheel 104 from motor 110 to release push pad 90 and launch bowling ball 24.

Figure 2G:
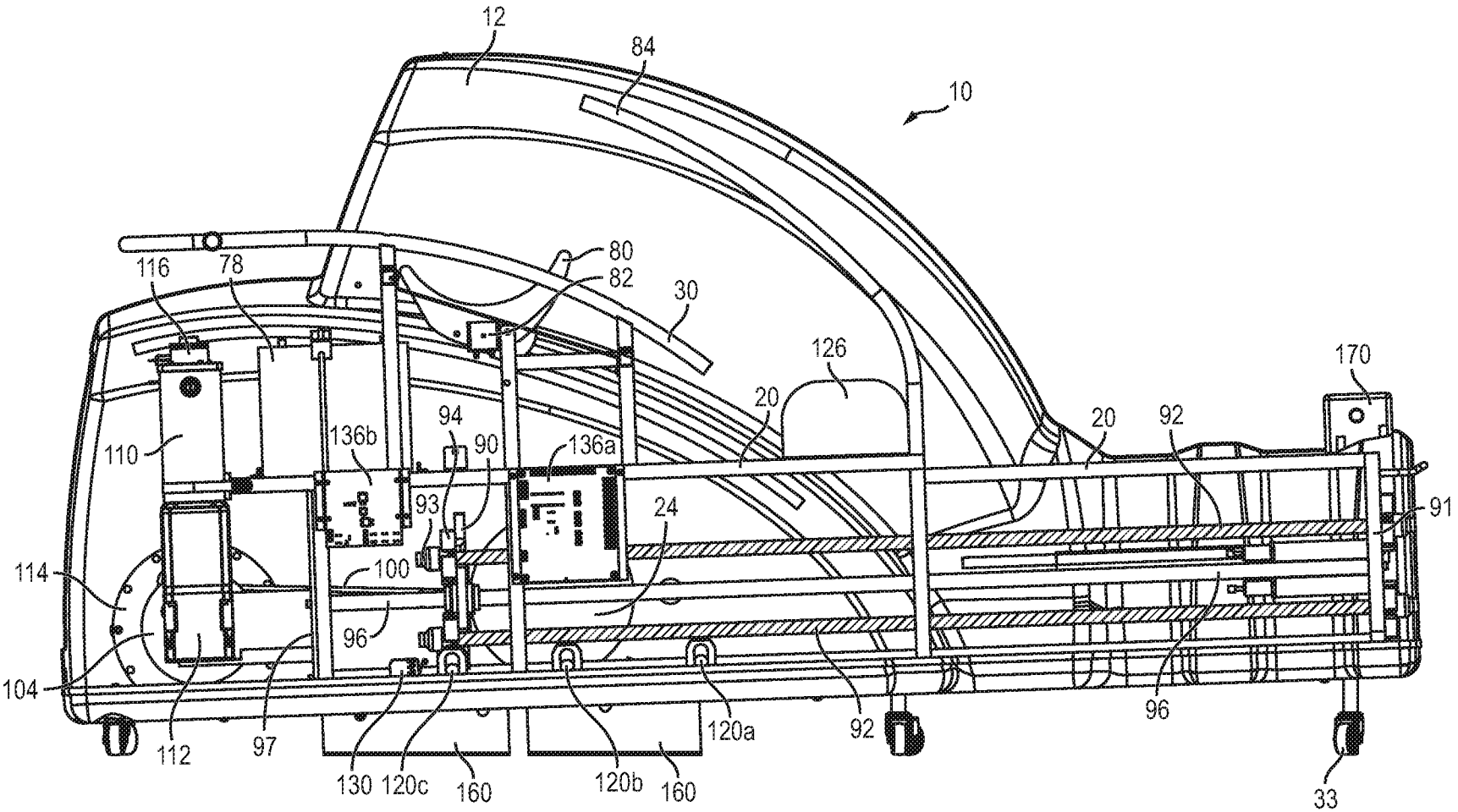

In FIG. 2*g*, motor 110 has turned winch wheel 104 sufficiently to move push pad 90 back to the third power position. Motor 110 stops turning winch wheel 104 when sensor 120*c* detects push pad 90, indicating that the third power position has been reached. Ball 24 rolls back on rails 140 as push pad 90 is pulled back.

Cannon 10 includes a friction brake 160 on the bottom of the cannon. Brake 160 extends downward under the bottom of shell 12. Push pad 90 includes a wheel that rolls along the top of brake 160 and presses the brake down against the floor of the bowling alley. When push pad 90 is pulled back to the second or third power position, the push pad engages brake 160. Brake 160 applies friction between cannon 10 and the bowling alley floor to resist kickback from launching of ball 24. Brake 160 is spring loaded to automatically raise once the ball is launched.

Figure 2H:
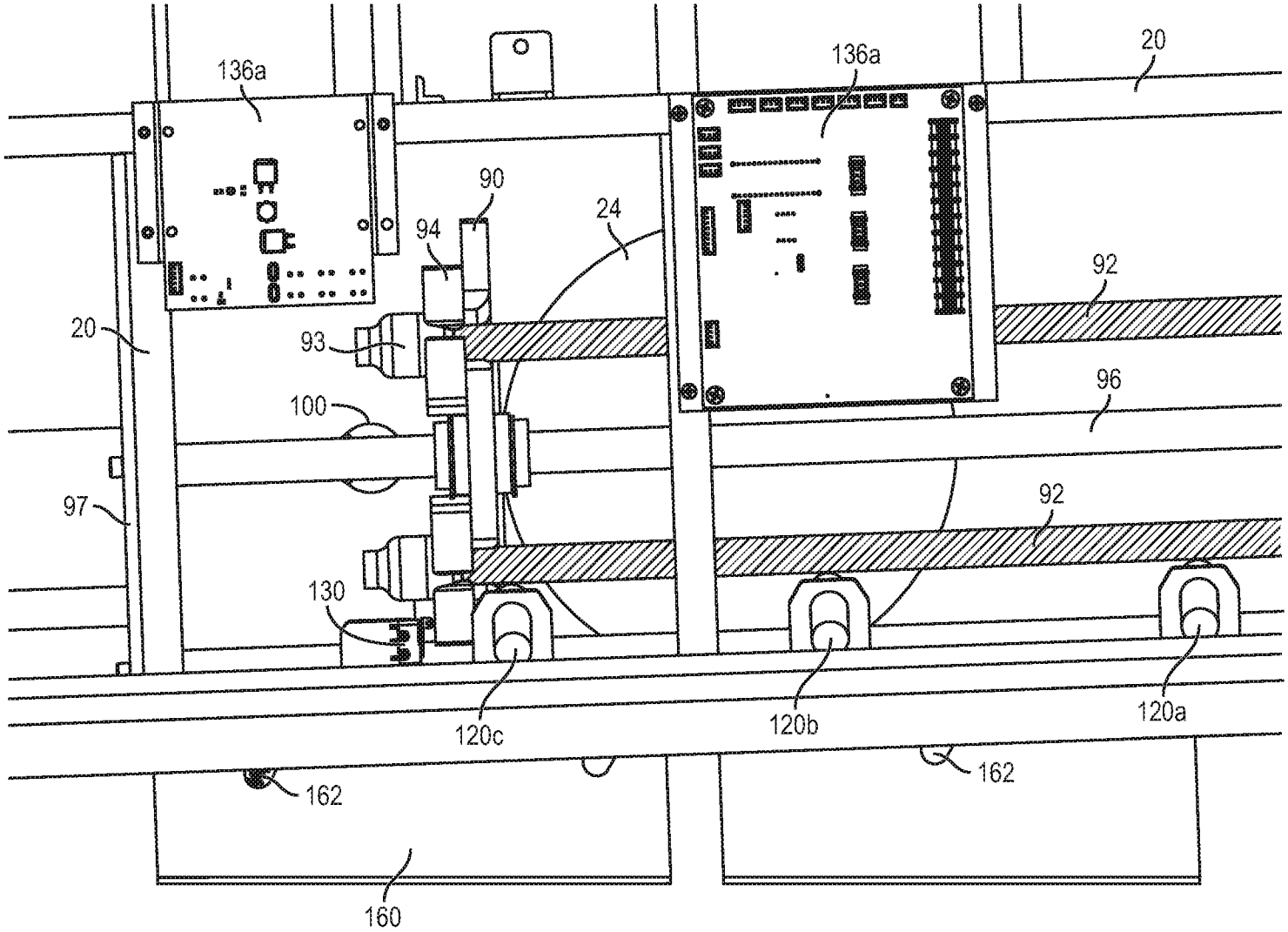

If sensor 120*c* fails to detect push pad 90 for some reason, motor 110 continues to turn winch wheel 104 past the last power position. Push pad 90 quickly reaches safety switch 130 and presses the switch as shown in FIG. 2*h*. Switch 130 is electrically connected to logic board 136*a* to allow the logic board to handle the error. Safety switch 130 increases safety by preventing motor 110 from running indefinitely when sensors 120 malfunction, which could damage cannon 10 and potentially cause injury to the user.

FIG. 2*h* also illustrates springs 162 that operate brake 160. Springs 162 are located within openings in brake 160. Springs 162 and the openings are sloped toward the top-front and bottom-rear of cannon 10. When plate 90 moves back and reaches brake 160, the brake is pushed back and down at approximately a forty-five degree angle. The angle allows plate 90 to push down brake 160 with a reduced chance of binding relative to vertical motion. However, springs 162 are oriented vertically or another angle in other embodiments.

Figure 2I:
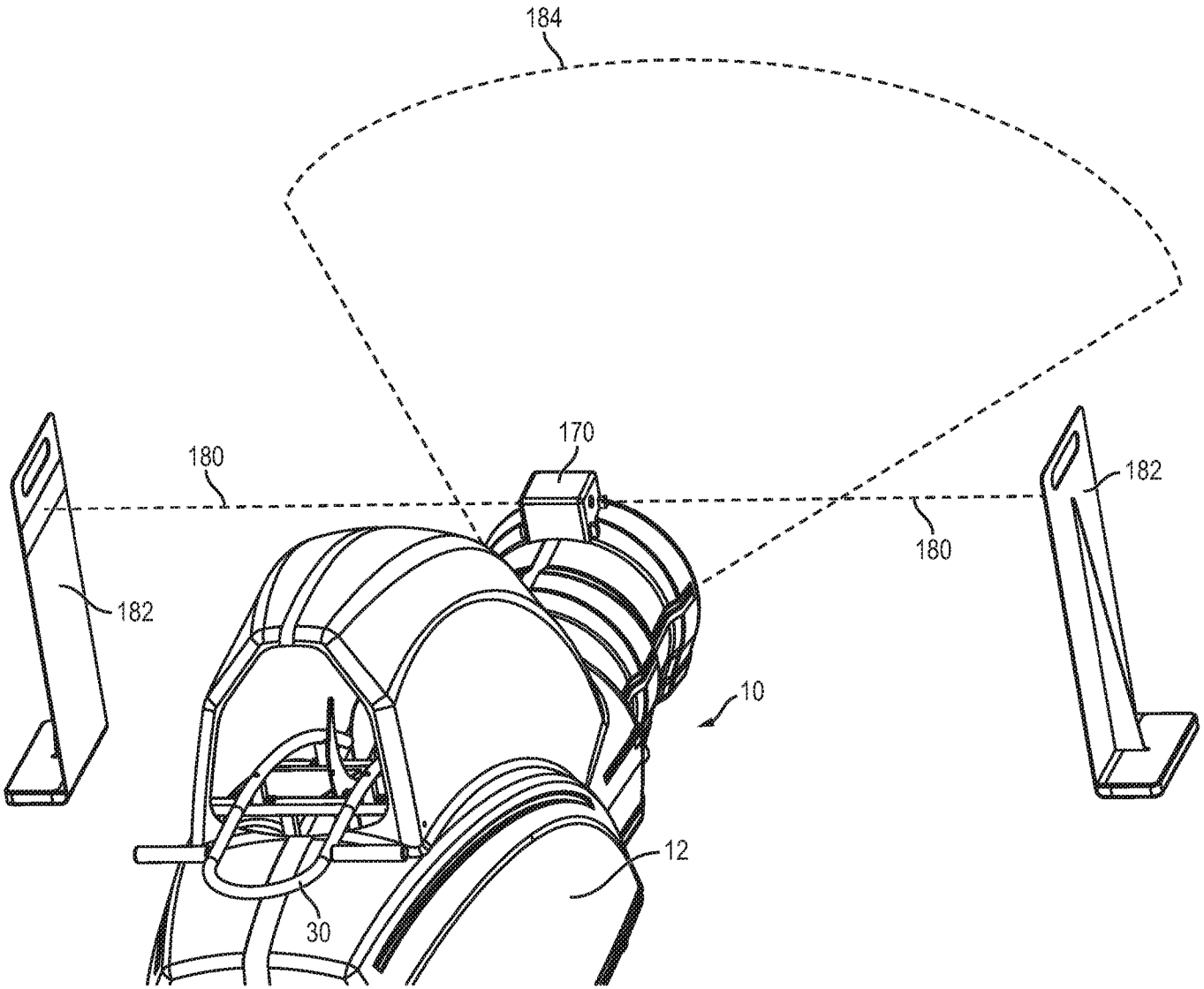

FIG. 2*i* illustrates additional safety features of cannon 10. Cannon 10 includes a light sensor 170 disposed over barrel opening 36, and an ultrasonic sensor 172 disposed under the barrel opening. Ultrasonic sensor 172 is visible in FIGS. 1*b* and 2*d*. Light sensor 170 includes two emitters within a housing that each emit a beam of light 180 that bounces off of reflective strips on a respective safety tower 182. Light sensor 170 includes a photodiode or other suitable element that detects the reflected light to confirm the positioning of cannon 10 relative to the bowling lane. Towers 182 are weighted to stay in position at the sides of the bowling lane. In other embodiments, towers 182 can be permanently installed flanking some or all of the lanes at a bowling alley.

Light sensor 170 looks for the positioning of towers 182 relative to cannon 10 to ensure that the cannon is aimed properly down a bowling lane and not in some arbitrary direction. In some embodiments, light sensor 170 emits a plurality of light rays 180 at a variety of angles and determines the angle of cannon 10 by which rays are reflected. Firing of cannon 10 can be disabled if light sensor 170 does not detect towers 182, or if the angle of the cannon relative to the towers is potentially dangerous.

Ultrasonic sensor 172 uses sonar technology to detect objects in front of cannon 10. Ultrasonic sensor 172 sends out inaudible sound waves in a cone 184 that echo off of objects within the cone. Detection of objects, such as other bowlers, is sent to logic board 136*a*, which can prevent cannon 10 from firing until the object is cleared. In other embodiments, other object detection technologies, such as radar or lidar, are used instead of or in addition to sonar. In some embodiments, safety sensors 170 and 172 are checked when ready button 54 is pressed.

Figure 2J:
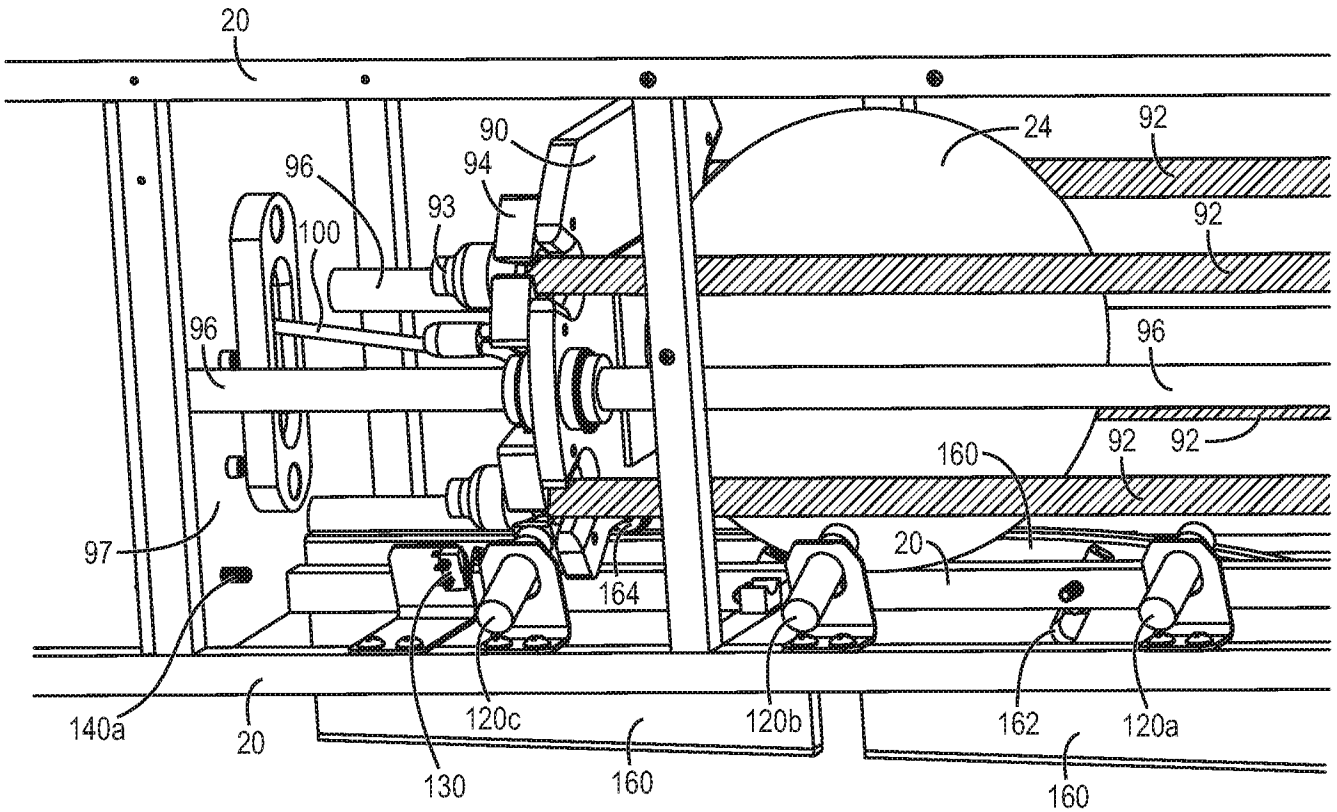

FIG. 2*j* illustrates details of the launch mechanism with push pad 90 at the third power position. Wheel 164 of push pad 90 is visible pressing down on brake 160. One of the railings 140 was removed to provide visibility to wheel 164. A bolt 140*a* remains visible where railing 140 was attached to rear plate 97. Brake 160 includes rubber, or another material that provides relatively high friction against a bowling alley floor, on the bottom of the brake. The rubber is provided in a strip oriented in parallel with the firing direction of cannon 10. The parallel orientation increases the force brake 160 can apply against firing of cannon 10, while still allowing the cannon to be aimed using left-to-right movements.

With ball 24 in the third power position, the user can press ready button 54. Logic board 136*a* confirms all safety checks have passed, then lights up fire button 56. The user presses fire button 56 to launch ball 24. In some embodiments, ready button 54 will flash or light up to remind users to press the button. Once ready button 54 is pressed, fire button 56 lights up or flashes. Cannon 10 can generate a "ready to fire" sound effect or voice from speaker 64.

When the user presses fire button 56, power board 136*b* supplies power to clutch 114. Electromagnetic forces repel brake pad 158 from rotor 154, allowing winch wheel 104 to rotate freely. The energy stored in elastic bands 92 cause the elastic bands to retract, pulling push pad 90 forward rapidly. Ball 24 is propelled forward along with push pad 90. Cable 100 is unwound from winch wheel 104 by the movement of push pad 90 away from the winch wheel. Clutch 114 can reengage after a fixed period of time or can detect when winch wheel 104 stops spinning and reengage.

Figure 2K:
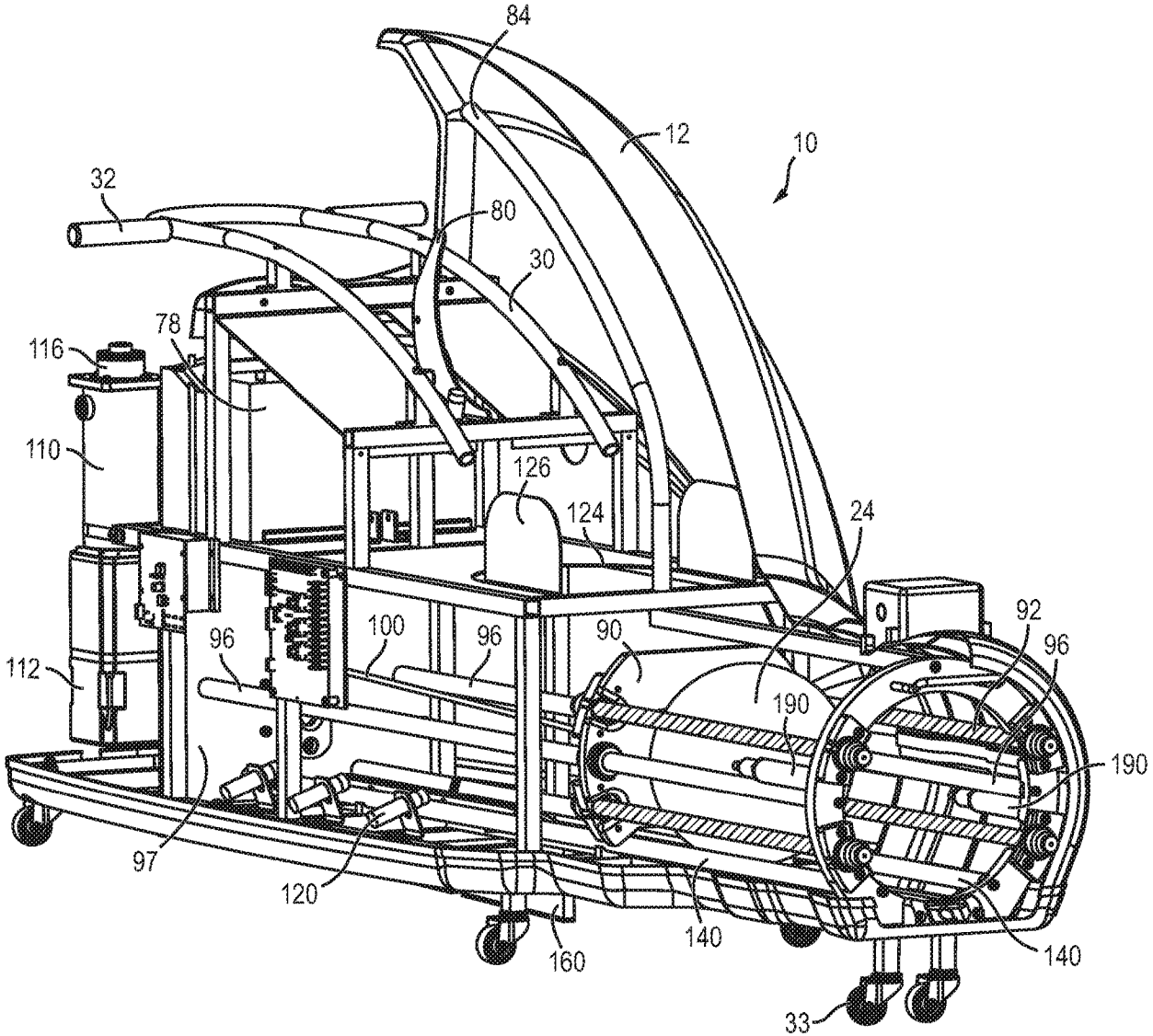
Figure 21:
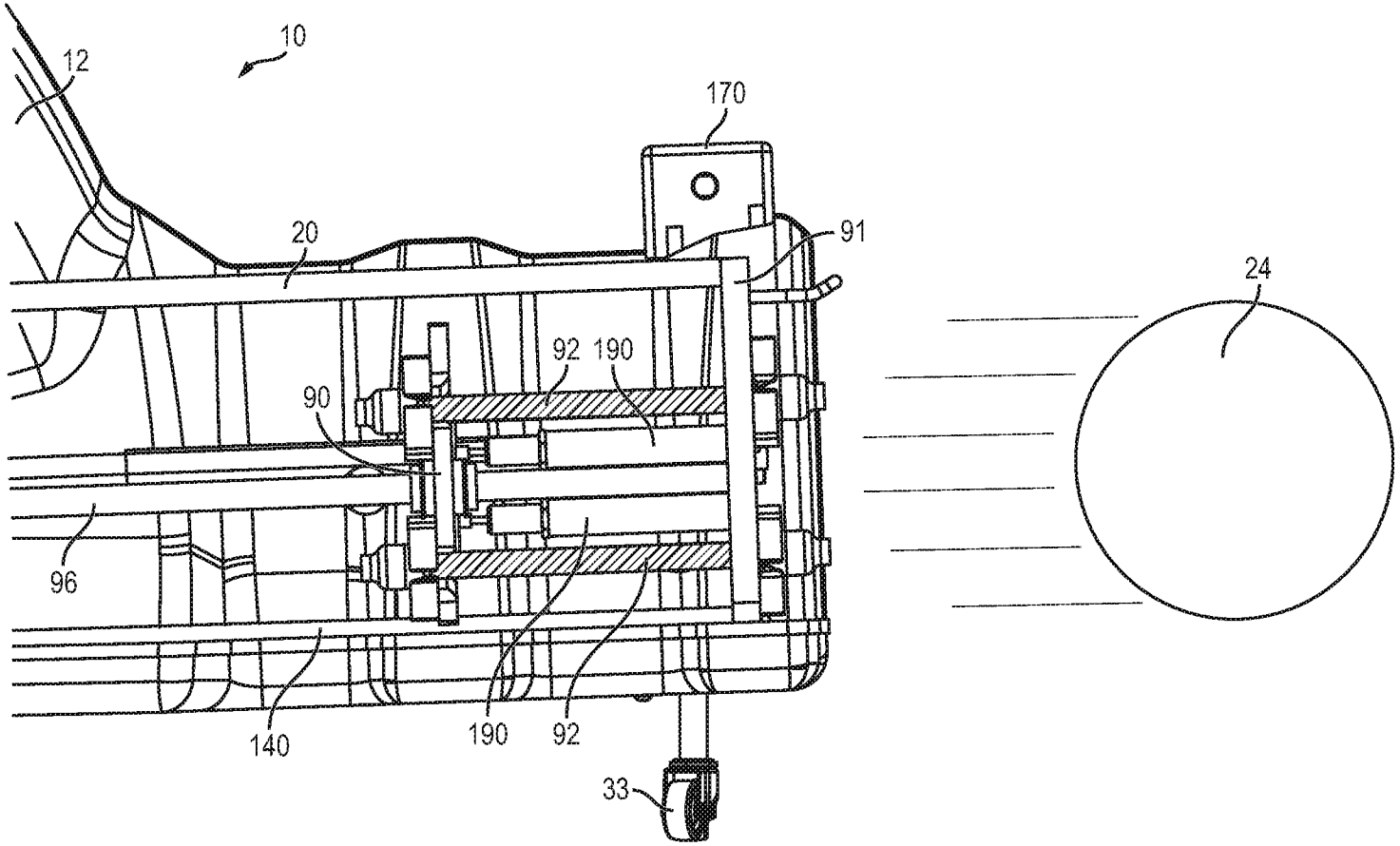

FIG. 2*k* illustrates cannon 10 after elastic bands 92 have brought push pad 90 most of the way toward barrel opening 36. Ball 24 rolls along rails 140 while being propelled by push pad 90. Push pad 90 continues propelling ball 24 forward until the push pad hits shock absorbers 190. Shock absorbers 190 are installed on barrel frame 91 and oriented toward the back of cannon 10. Shock absorbers 190 cushion the impact of push pad 90 at the front of the barrel.

Push pad 90 stops against shock absorbers 190 while ball 24 continues moving out of barrel opening 36 as illustrated in FIG. 2*l*. In some embodiments, elastic bands 92 retain some tension that holds push pad 90 against shocks 190. Ball 24 flies forward down the bowling lane to strike the pins at the other end with a satisfying collision. Cannon 10 can immediately begin pulling back push pad 90 to the first power position to prepare for the next shot. Cannon 10 is programmed with timing for the typical amount of time bowling balls take to reach the pins at the various power levels and can give audible encouragement timed for just after ball 24 hits the bowling pins, e.g., "Great shot!!"

While one or more embodiments of the present invention have been illustrated in detail, the skilled artisan will appreciate that modifications and adaptations to those embodiments may be made without departing from the scope of the present invention as set forth in the following claims.

What is claimed:

1. A bowling ball launcher, comprising:

a frame;

a pair of first rails oriented from a front of the frame to a back of the frame;

a push pad configured to slide along the first rails, wherein a surface of the push pad extends completely around the first rails;

a pair of second rails oriented parallel to the first rails and disposed under the push pad, wherein the second rails are configured to support a bowling ball in direct contact with the second rails;

a first elastic mechanism coupled to the push pad above the first rails and extending toward the front of the frame;

a second elastic mechanism coupled to the push pad below the first rails and extending toward the front of the frame;

a winch coupled to the push pad toward the back of the frame; and a railing disposed over the frame, wherein the railing slopes down from a back of the frame to allow the bowling ball to roll down the railing, fall through an opening in the frame, and land on the second rails.

2. The bowling ball launcher of claim 1, wherein the winch includes:

a motor;

a winch wheel; and a cable extending from the winch wheel to the push pad.

3. The bowling ball launcher of claim 2, wherein the winch further includes a clutch coupled between the motor and the winch wheel.

4. The bowling ball launcher of claim 1, further including a plurality of proximity sensors attached to the frame, wherein the plurality of proximity sensors is configured to detect a presence or absence of the push pad adjacent to each respective proximity sensor.

5. A bowling ball launcher, comprising:

a push pad;

a first rail disposed under the push pad, wherein the first rail is configured to allow a bowling ball to roll on the first rail when propelled by the push pad;

a second rail disposed through the push pad, wherein a bowling ball loaded into the bowling ball launcher rests directly on the first rail and within a height of the second rail;

an elastic mechanism configured to propel the push pad forward within the bowling ball launcher; and a motor configured to add energy to the elastic mechanism.

6. The bowling ball launcher of claim 5, further including:

a winch wheel, wherein the motor adds energy to the elastic mechanism by turning the winch wheel; and a cable coupled from the winch wheel to the push pad.

7. The bowling ball launcher of claim 5, further including a spring-loaded brake configured to be pushed down under the bowling ball launcher by the push pad when the push pad is pulled back by the motor.

8. A method of launching a bowling ball, comprising:

providing a bowling ball launcher comprising a push pad;

pulling back the push pad to a first position sensor, wherein the push pad is automatically pulled back to the first position sensor after a previous bowling ball is fired;

receiving the bowling ball in the bowling ball launcher after pulling back the push pad to the first position sensor;

transferring the bowling ball onto a first rail of the bowling ball launcher in front of the push pad after receiving the bowling ball in the bowling ball launcher;

pulling back the push pad to a second position sensor after receiving the bowling ball, and in response to a control input by a user, to increase an energy stored in an elastic mechanism attached to the push pad, wherein the bowling ball rolls back on the first rail as the push pad is pulled back; and releasing the push pad, wherein the energy stored in the elastic mechanism propels the push pad and the bowling ball rolls forward on the first rail in front of the push pad after the push pad is released.

9. The method of claim 8, further including pulling back the push pad using a winch.

10. The method of claim 9, further including releasing the winch by disengaging a clutch of the winch.

11. The method of claim 8, further including:

aiming the bowling ball launcher by moving the bowling ball launcher on caster wheels; and pulling back the push pad after aiming the bowling ball launcher, wherein pulling back the push pad causes the push pad to press down on a spring-loaded brake.

12. The method of claim 8, wherein the push pad slides on a pair of second rails disposed through openings of the push pad and the push pad extends below the second rails.

13. The method of claim 8, further including:

receiving the bowling ball on a railing of the bowling ball launcher; and using a ball prevention mechanism disposed adjacent to the railing to delay loading of the bowling ball onto the first rail until the first rail is clear of other bowling balls and the push pad is behind a front end of the railing.

14. The bowling ball launcher of claim 7, further including a caster wheel disposed under the bowling ball launcher.

15. The bowling ball launcher of claim 1, further including a bushing or bearing disposed in the push pad between the first rails and the push pad.

16. The bowling ball launcher of claim 1, further including:

a first safety tower disposed to a first side of the bowling ball launcher;

a second safety tower disposed on a second side of the bowling ball launcher opposite the first side; and a light sensor attached to the frame and configured to detect a position of the bowling ball launcher relative to the first safety tower and second safety tower.

17. The bowling ball launcher of claim 1, further including:

a caster wheel attached under the frame; and a spring-loaded brake attached under the frame, wherein the push pad is configured to engage the brake when the push pad is pulled back.

18. The bowling ball launcher of claim 1, further including a ball prevention mechanism disposed along the railing and configured to block a second bowling ball from rolling down the railing while the bowling ball remains on the second rails.

* * * * *